United States Patent [19]

Moore, Jr.

[11] Patent Number: 4,662,314

[45] Date of Patent: May 5, 1987

[54] MAGNETIC WATER CONDITIONING DEVICE

[75] Inventor: Henry J. Moore, Jr., Los Angeles, Calif.

[73] Assignee: Mor-Flo Industries, Inc., Cleveland, Ohio

[21] Appl. No.: 779,471

[22] Filed: Sep. 25, 1985

[51] Int. Cl.[4] ..... F22B 37/18; F22B 37/48

[52] U.S. Cl. ..... 122/379; 122/13 R; 210/222

[58] Field of Search ..... 122/13 R, 14, 379; 210/222, 223, 695

[56] References Cited

U.S. PATENT DOCUMENTS

| | | | |
|---|---|---|---|
| 50,773 | 10/1865 | Parry | 204/147 |
| 2,257,385 | 9/1941 | Keegan | 122/13 R |
| 2,592,863 | 4/1952 | Conner | 122/13 R |
| 2,652,925 | 9/1953 | Vermeiren | 210/1.5 |
| 2,678,729 | 5/1954 | Spodig | 210/1.5 |
| 2,825,464 | 3/1958 | Mack | 210/222 |
| 2,937,710 | 5/1960 | Michael et al. | 183/7 |
| 3,228,878 | 1/1966 | Moody | 210/57 |
| 3,669,274 | 6/1972 | Happ et al. | 210/222 |
| 3,680,705 | 8/1972 | Happ et al. | 210/222 |
| 3,923,660 | 12/1975 | Kottmeier | 210/222 |
| 3,951,807 | 4/1976 | Sanderson | 210/222 |
| 4,216,092 | 8/1980 | Shalhoob et al. | 210/222 |
| 4,278,549 | 7/1981 | Abrams et al. | 210/695 |
| 4,289,621 | 9/1981 | O'Meara, Jr. | 210/222 |
| 4,397,296 | 8/1983 | Moore, Jr. et al. | 126/360 |
| 4,417,984 | 11/1983 | O'Meara, Jr. | 210/695 |
| 4,519,919 | 5/1985 | Whyte et al. | 210/695 |
| 4,564,448 | 1/1986 | O'Meara, Jr. | 210/695 X |

*Primary Examiner*—Albert J. Makay
*Assistant Examiner*—Steven E. Warner
*Attorney, Agent, or Firm*—Body, Vickers & Daniels

[57] ABSTRACT

A magnetic scale inhibiting device is easily installed in a water heater inlet dip tube without the need of an external housing. The device comprises a number of thin magnets held in aligned relationship within the dip tube by resilient spacers which engage the magnet and the dip tube.

11 Claims, 4 Drawing Figures

MAGNETIC WATER CONDITIONING DEVICE

BACKGROUND OF THE INVENTION

The present invention pertains generally to magnetic water conditioning devices and more particularly to magnetic water conditioning devices disposed within a water heater.

Over the last several years the efficiency of commercial and residential water heaters has been improved in response to the increasing cost of fuel. One such improved efficiency design is described in U.S. Pat. No. 4,397,296. The water heater described in that patent, like most water heaters, comprises a water containing vessel, a water inlet pipe, a water outlet pipe, a combustion chamber and associated equipment.

A problem common to all water heaters, but of particular concern in high efficiency water heaters, is the formation of scale on the interior surfaces of the water containing vessel. This scale is formed from impurities in the water such as calcium salts and magnesium salts and adheres to the surfaces of the vessel including the surfaces of the combustion chamber through which heat is transferred to the water within the vessel. Scale build up on vessel surfaces, particularly combustion chamber surfaces, significantly impedes the efficient operation of the water heater by interfering with heat transfer to the water. In extreme cases, scale accumulation can cause operating temperatures of combustion chamber surfaces to rise and shorten the useful life of a water heater.

Magnetic devices have been used in the past to combat scale formation. In general, these devices operate by passing the water to be treated through magnetic fields. The scale forming salts are caused to nucleate in the water by the magnetic fields. The nucleated salts do not adhere to water heater surfaces to form harmful scale.

One of the most successful of these magnetic devices is described by Shalhoob et al in U.S. Pat. No. 4,216,092. Shalhoob describes a device to be inserted into a water heater cold water inlet pipe comprised of a non-magnetic cylindrical outer housing and a cylindrical insert contained within the housing. The housing contains the flow of water through the device and has a series of turbulence inducing circumferential ridges spaced along its length. The insert consists of a series of cylindrical magnets having their magnetic poles on their axial ends separated from one another by cylindrical spacers. Adjacent magnets have similar poles facing one another across the intervening spacers. This arrangement provides strong radial magnetic fields concentrated at the ends of the magnets. Water passing through the device flows through the magnetic fields in a direction perpendicular to the strong radial magnetic fields. Magnetic effects on ions and salts contained in the water are most pronounced when the direction of water flow is perpendicular to the magnetic fields. Salts are caused to nucleate in the flowing water rather than on the interior surfaces of the water heater vessel. The magnetically nucleated salts are then flushed from the system.

The device described by Shalhoob is a complex device. The large cylindrical insert requires that the housing have a much larger diameter than the pipe feeding water to the device in order to maintain adequate flow. Therefore, the device must be added on the water heater by cutting out a segment of the cold water inlet pipe and replacing the removed segment with the device. Moreover, the housing itself must be processed into a complex form to provide flow restriction ridges. This adds to the cost of the device. The magnetic fields of the Shalhoob device have large components perpendicular to the direction of water flow only near the magnetic poles. Over most of the length of the device, the principal direction of water flow and the magnetic fields are substantially parallel.

SUMMARY OF THE INVENTION

The present invention contemplates a new and improved apparatus and method which overcomes all of the above referred to problems and others and provides a magnetic water conditioning device which is an integral part of the water heater it is protecting and is easily and economically installed in the water heater.

In accordance with the present invention, there is provided a magnetic scale inhibiting apparatus comprised of a plurality of thin magnets assembled with spacers and disposed within the inlet tube of a heater. The magnets are orientated with their north poles all on one side of the axis of the inlet tube and their south poles all on the opposite side of the axis of the inlet tube thereby providing magnetic fields of semi-circular shape perpendicular to the axis of the inlet tube and thus, the principal direction of water flow, over the entire length of the apparatus.

Further in accordance with the invention, the spacers between adjacent magnets comprise transverse sections interconnecting longitudinal sections and forming receptacles for the ends of adjacent magnets firmly locking them in assembled position.

Yet further in accordance with the invention, the transverse sections of the spacers extend laterally outwardly from the longitudinal sections providing turbulence inducing ridges.

Yet further in accordance with the invention, the spacers are somewhat resilient and are sized to engage the sides of the tube in which the device is inserted, thereby allowing an assembled magnetic scale inhibiting device to be pushed into an inlet tube to a desired position which the device will maintain.

Yet further in accordance with the invention, the magnets have a width only slightly less than the inside diameter of the inlet tube and a thickness small in comparison to their width.

Still further in accordance with the invention, the magnetic scale inhibiting device is contained within the dip tube portion of a water heater inlet contained within the water heater vessel itself.

Still further in accordance with the invention, the magnetic scale inhibiting device is assembled with the water heater by pushing it into the dip tube.

The principal object of the present invention is the provision of a magnetic scale inhibiting device within a water heater.

Another object of the present invention is the provision of a magnetic scale inhibiting device of small cross section which will only minimally impede the flow of a fluid around it.

Still another object of the present invention is the provision of a magnetic scale inhibiting device which does not require a housing having a larger diameter than the tube into which it is inserted.

Yet another object of the present invention is the provision of a magnetic scale inhibiting device providing a magnetic field which is almost uniformly perpendicular to the principal direction of fluid flow around the device.

Still another object of the present invention is the provision of a magnetic scale inhibiting device which can be easily positioned in the dip tube of a water heater by pushing it into the dip tube to the desired position which it will maintain.

Still another object of the present invention is the provision of a magnetic scale inhibiting device which will induce turbulent fluid flow in the areas of maximum usable magnetic field strength and accelerated flow in the areas of minimum magnetic field strength.

The invention may take physical form in certain parts and arrangements of parts, the preferred embodiment of which will be described in detail in the specification and illustrated in the accompanying drawings which form a part hereof.

DESCRIPTION OF THE PREFERRED EMBODIMENT

Figure 1:
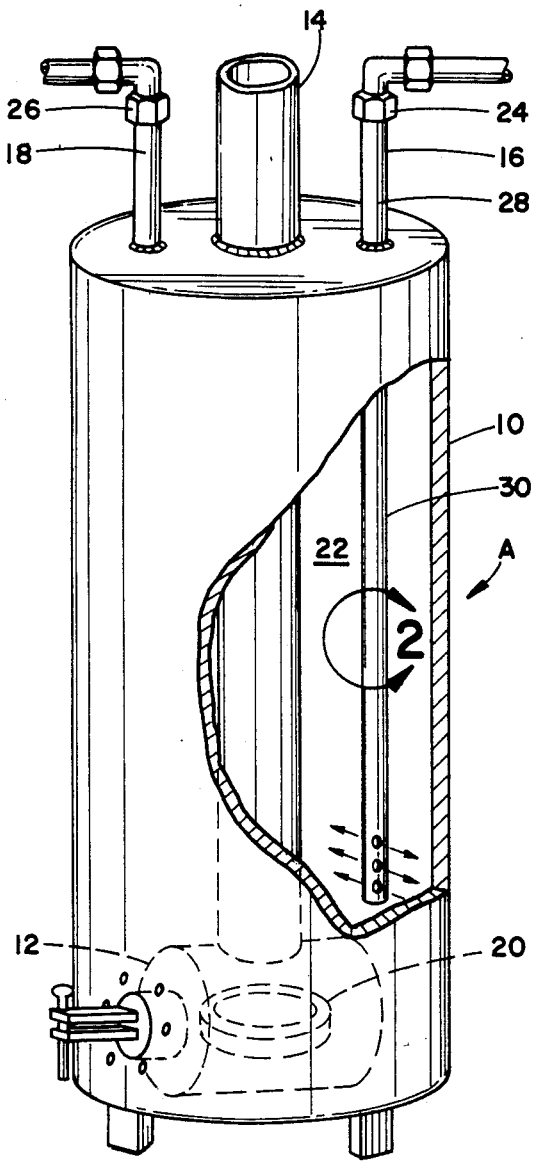
FIG. 1 is a side elevation of a water heater, partially broken away, showing the major elements of the water heater and the location of the magnetic scale inhibiting device.

Referring now to the drawings, wherein the showings are for the purposes of illustrating a preferred embodiment of the invention only and not for the purposes of limiting same, the figures show a water heater A comprised of a water containing vessel 10, a combustion chamber 12 contained within the water containing vessel, a flue tube 14 extending vertically from the combustion chamber through the water containing vessel and exiting through its top, a cold water inlet 16 and a hot water outlet 18. Combustion chamber 12 contains a burner 20 which provides heat to the combustion chamber surfaces thereby heating the water 22 contained in the vessel 10. The cold water inlet 16 and the hot water outlet 18 are connected to the building plumbing system through unions 24, 26. Additionally, the water heater includes a thermostat and control mechanism (not shown) feeding fuel to the burner 20 and an insulating jacket (not shown) surrounding the water containing vessel 10 in a conventional manner. All of the above referred to elements are conventional and operate in a conventional manner.

All water entering the water heater A to be heated enters through the cold water inlet 16 which is comprised of an exterior portion 28 and a portion interior to the water containing vessel 10 known as the dip tube 30. The exterior portion 28 and the dip tube 30 are comprised of a continuous piece of tubing having a circular cross section and constant diameter which is preferably plastic but may be brass or any other non-ferrous material.

Figure 2:
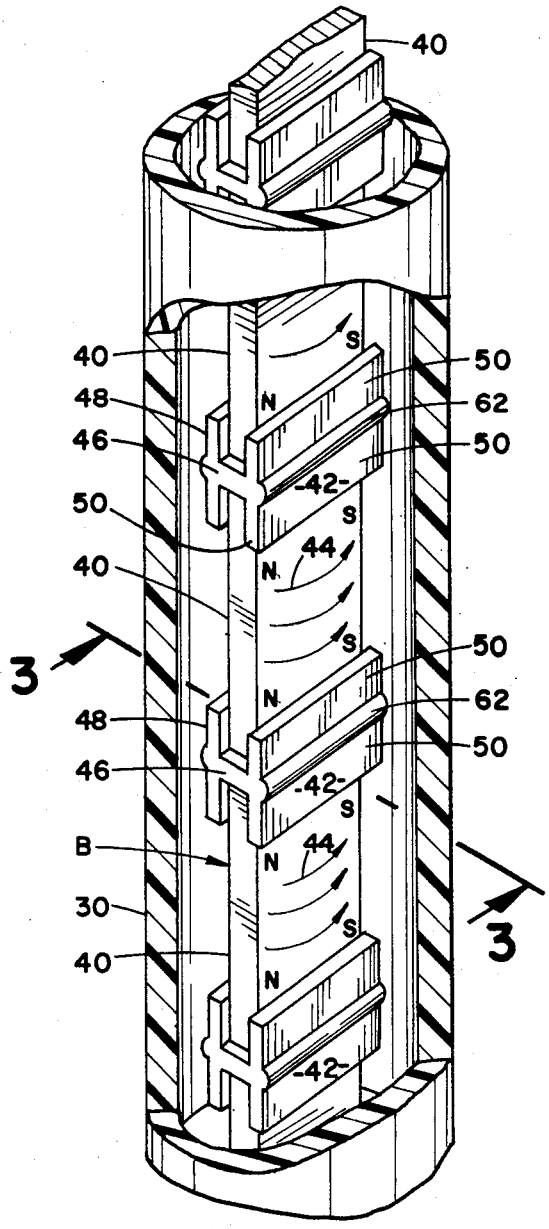
FIG. 2 is a greatly enlarged broken away view showing the dip tube portion of water heater inlet tube broken away with the magnets and spacers forming the magnetic scale inhibiting device disposed there within.

FIG. 2 shows a broken away segment of the dip tube 30 containing a magnetic water conditioning device B comprised of a plurality of identical magnets 40 spaced from one another by a plurality of identical spacers 42.

Each magnet 40 is a bar magnet of uniform rectangular cross section. Each magnet is disposed along a diameter of the dip tube 30 with the long dimension of the magnet being disposed parallel to the axis of the dip tube. The width of the magnets is slightly less than the inside diameter of the dip tube 30 such that the magnets may be moved along the axis of the dip tube. The thickness of the magnets is substantially less than the width of the magnets and therefore substantially less than the interior diameter of the dip tube 30 such that fluid may flow past the magnets 40 on either side of their width.

Each of the magnets 40 has a single north pole N and a single south pole S. The north poles N of all the magnets 40 are disposed along one side of the axis of the dip tube 30 and the south poles S are disposed along the opposite side of the dip tube axis. Magnetic lines of force 44 representing the magnetic fields produced by the magnets 40 emanate from the north poles N and proceed in a circumferential direction to the south poles S. Because all of the magnets have the same orientation with all of the north poles N on the first side of the axis of the dip tube 30 and all of the south poles S on the second side of the axis of the dip tube, lines of magnetic force do not interconnect adjacent magnets. The magnetic lines of force all proceed from the north pole N of one magnet to the south pole S of the same magnet. Therefore, the magnetic fields produced by the magnets 40 are generally perpendicular to the axis of the dip tube 30 and, hence, the principal direction of fluid flow through dip tube 30. Moreover, the magnetic poles extend along the entire length of each magnet 40. Uniform magnetic fields 44 perpendicular to the axis of the dip tube 30 over the length of each magnet are provided.

Figure 3:
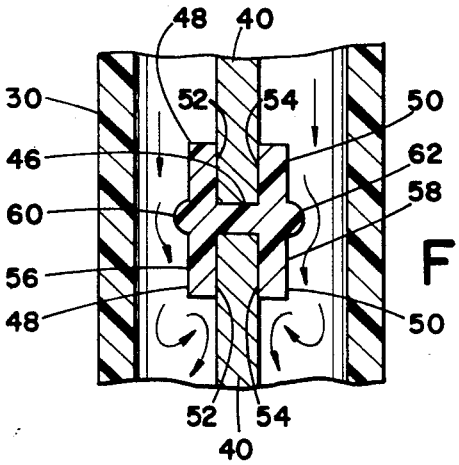
FIG. 3 is a cross section of the dip tube and contained magnetic device taken along line 3—3 of FIG. 2; and, FIG. 4 is a cross section of an alternate spacer and end piece for use in the magnetic scale inhibiting device.

The magnets 40 are held in place and separated from one another by several H-shaped spacers 42. The spacers 42 are seen in perspective in FIG. 2 and in cross section in FIG. 3. Each spacer has a width substantially equal to the inside diameter of the dip tube 30. Because of the curvature of the cross section of the dip tube 30, the spacers 42 have a slight interference fit when installed in the dip tube 34. Each spacer is comprised of a transverse member 46 and two longitudinal members 48, 50. The transverse member 46 is thin and separates adjacent magnets 40 by a small distance only. The longitudinal members 48, 50 have a substantially constant thickness, are parallel to one another, and engage the opposite sides of two adjacent magnets 40 over the entire width of the magnets. The two longitudinal members are interconnected at their longitudinal centers by the tranverse member 46. Thus, the interior surfaces 52, 54 of the longitudinal members 48, 50 and the surfaces of the transverse member 46 form receptacles tightly receiving the ends of two adjacent magnets 40. The ends of the adjacent magnets 40 are thereby protected from damage and held in alignment closely spaced from one another. The magnetic fields produced by the magnets 40 are therefore substantially continuous over the entire length of the magnetic water conditioning device B and perpendicular to the axis of the dip tube 30.

The spacer transverse member 46 extends slightly beyond the outside surfaces 56, 58 of the longitudinal members 48, 50. These extensions form two turbulence inducing ridges 60, 62 extending across the entire width of the spacer 42. Of course, the ridges 60, 62 could be replaced by a series of round bumps or other shapes and still obtain the turbulence desired.

The magnetic water conditioning device B is installed into the water heater by first inserting a spacer 42 into the cold water inlet 16, placing a magnet 40 into the spacer 42 and pushing it into the inlet 16. Additional magnets 40 and spacers 42 are alternately inserted until the desired number of magnets are in place. Once the final spacer 42 is assembled on top of the last magnet, a push rod (not shown) is inserted into the cold water inlet 16 and the assembled magnetic water conditioning device B is pushed downwardly into the dip tube 30 to its desired position. Because the spacers are resilient and sized to have a slight interference with the inside of the dip tube 30, the assembly can be easily pushed into the dip tube but, once at its desired position, will hold its place under normal flow conditions.

Once the magnetic water conditioning device B is installed and the water heater is filled, water will flow through cold water inlet 16 and dip tube 30 past the magnetic water conditioning device B. Because the magnets 40 are thin and the spacers 42 are not substantially thicker than the magnets, full flow through the inlet tube is not appreciably impeded.

Water flowing past the magnetic water conditioning device B is traveling principally perpendicularly to the lines of magnetic force 44. Maximum force upon calcium salts and the like is therefore induced. This causes auto-nucleation of these salts. Turbulence is induced in the flow of water by the presence of the spacers 42, which are slightly wider than the magnets, and the turbulence inducing ridges 60, 62. This turbulence mixes the water allowing auto-nucleated salt particles to agglomerate and be carried away.

Figure 4:
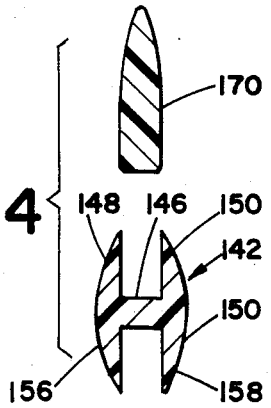

FIG. 4 shows an alternate spacer design. The alternate spacer 142 is H-shaped in cross section and comprised of a transverse member 146 and two longitudinal members 148, 150. The alternate spacer 142 engages adjacent magnets 40 in a manner identical to the primary spacer 42. The outside surfaces 156, 158 of the longitudinal members 148, 150 of the alternate spacer are curved such that the longitudinal members each have a very thin leading edge, a wide central portion, and a very thin trailing edge. No turbulence inducing bumps are provided. Streamlined surfaces at the junction of adjacent magnets are provided when the alternate spacer 142 is used in place of spacer 42. Also, the alternate spacer 142 occupies less of the cross sectional area of the dip tube 30 than the primary spacer 42. An end insert 170 fits into the recess between the spacer longitudinal members 148, 150 of the top spacer in the magnetic device B. An identical end insert fits into the unoccupied recess of the bottom spacer in the magnetic device B. The end inserts have a bullet shaped cross section and create a streamlined leading edge and trailing edge for the magnetic device B further reducing turbulence. The entire magnetic water conditioning device B presents less resistance to flow when alternate spacers 142 and end inserts 170 are used. More flow through the dip tube 30 can therefore be accommodated. While more flow is accommodated, somewhat less turbulence and mixing of auto-nucleated particles is induced and, therefore, less agglomeration occurs.

Two particular embodiments of the magnetic water conditioning device B have been described. Both of these devices can be inserted into any tubular, non-magnetic water containing vessel of appropriate diameter and perform the anti-scale formation function described. While the device has been described with specific reference to a water heater dip tube, the device can also be used by insertion into any feed water tube leading to any water processing or consuming device. This is accomplished by sizing the spacers and magnets to fit the diameter of the tube into which they are to be inserted and pushing the assembly into the tube to its desired position. No special housing is required.

Obviously, modifications and alterations will occur to others upon the reading and understanding of this specification. It is my intention to include all such modifications and alterations insofar as they come within the scope of the appended claims or the equivalents thereof. Having thus described the invention, the following is claimed.

I claim:

1. Apparatus for inhibiting the formation of scale in a water containing vessel having a water containing inlet pipe having a region of constant interior width dimension and a central axis comprising:

a plurality of magnets disposed within said region of constant interior width dimension within said water containing inlet pipe, each said magnet having a magnetic north pole region and a magnetic south pole region, a width dimension between a first side edge and a second side edge, said first and second side edges being disposed on opposite sides of said central axis within said inlet pipe and having a height dimension between a bottom and a top and a thickness dimension between a first side face and a second side face, said width dimension being less than said inlet pipe constant interior width; said thickness dimension being small in comparison to said width and height dimensions, said magnetic north pole region disposed along said first side edge; and, second magnetic south pole region disposed along said second side edge; and, resilient spacers between said magnetic members interconnecting the tops and bottoms of adjacent magnets and fixing said magnets in place within said inlet pipe.

2. Apparatus for inhibiting the formation of scale in a water containing vessel having a dip tube of constant interior diameter extending into said vessel comprising:

a plurality of thin rectangular magnets having a maximum width less than said dip tube interior diameter; and, a plurality of spacers interconnecting adjacent magnets, said spacers being fabricated from a slightly deformable plastic material and having an interference fit in the interior of said dip tube such that said magnets and said spacers may be assembled and pushed into said dip tube and will maintain their installed position within said dip tube.

3. The apparatus of claim 2 wherein said spacers are comprised of a transverse member interconnecting two parallel longitudinal members having inner and outer surfaces, said transverse members being disposed between adjacent magnets and said longitudinal member inner surfaces lying against said magnets.

4. Apparatus for inhibiting scale formation in water containing vessels comprising:

a circular tube of constant diameter;

a plurality of magnets disposed within said tube, each said magnet having a magnetic north pole and a magnetic south pole, a width dimension between a first side edge and a second side edge, a height dimension between a bottom and a top and a thickness dimension between a first side face and a second side face, said width dimension being less than said tube diameter, said thickness dimension being small in comparison to said width and height dimensions, said magnetic north pole being disposed along said first side edge and said magnetic south pole being disposed along said second side edge; and, spacers between said magnets interconnecting the tops and bottoms of adjacent magnets, said spacers being comprised of a thin transverse member interconnecting two parallel longitudinal members having inner and outer surfaces, said transverse member being disposed between adjacent magnets and said longitudinal member inner surface lying against the first and second side faces of adjacent magnets.

5. The apparatus of claim 4 wherein said transverse member extends outwardly beyong the outer surfaces of said longitudinal members forming turbulence inducing transverse ridges.

6. The apparatus of claim 4 wherein said magnet width dimension is slightly less than said inlet pipe interior width.

7. Apparatus for inhibiting the formation of scale in a water containing vessel having a dip tube of constant interior diameter extending into said vessel comprising:

a plurality of thin rectangular magnets having a maximum width less than said dip tube interior diameter; and, a plurality of spacers interconnecting adjacent magnets and being comprised of a transverse member interconnecting two parallel longitudinal members having inner and outer surfaces, said transverse members extending beyond said longitudinal member outer surfaces forming turbulence inducing ridges, said transverse members being disposed between adjacent magnets and said longitudinal member inner surfaces lying against said magnets, said spacers being fabricated from a slightly deformable plastic material and having a width having an interference fit in the interior of said dip tube such that said magnets and said spacers may be assembled and pushed into said dip tube and said spacers and magnets will maintain their installed position within said dip tube.

8. The apparatus of claim 7 wherein said magnets having a magnetic north pole disposed along a first side edge and a magnetic south pole disposed along a second side edge.

9. The apparatus of claim 8 wherein said dip tube has an axis and said magnets are aligned such that all said magnetic north poles are aligned on a first end of a diameter of said dip tube and all said magnetic south poles are aligned on a second end of a diameter of said dip tube.

10. Apparatus for inhibiting the formation of scale in a water containing vessel having an inlet pipe having a region of constant interior width dimension comprising:

a plurality of magnets disposed within said region of constant interior width dimension, each said magnet having a magnetic north pole region and a magnetic south pole region, a width dimension between a first side edge and a second side edge, a height dimension between a bottom and a top and a thickness dimension between a first side face and a second side face; said width dimension being less than said inlet pipe constant interior width; said thickness dimension being small in comparison to said width and height dimensions, said magnetic north pole region disposed along said first side edge; and, said magnetic south pole region disposed along said second side edge; and, spacers between said magnetic members interconnecting the tops and bottoms of adjacent magnets, said spacers being comprised of a transverse member interconnecting two parallel longitudinal members having inner and outer surfaces, said transverse member being disposed between adjacent magnets and said longitudinal member inner surfaces lying against the first and second side faces of adjacent magnets.

11. The apparatus of claim 10 wherein said transverse member extends outwardly beyond the outer surfaces of said longitudinal members forming turbulence inducing transverse ridges.

* * * * *